United States Patent [19]

Carmack et al.

[11] Patent Number: 5,035,271

[45] Date of Patent: Jul. 30, 1991

[54] VAPOR RECOVERY FUEL DISPENSING NOZZLE

[75] Inventors: Paul D. Carmack, Tipp City, Ohio; Rodger P. Grantham, Springfield, Mo.

[73] Assignee: Catlow, Inc., Tipp City, Ohio

[21] Appl. No.: 503,464

[22] Filed: Apr. 2, 1990

[51] Int. Cl.[5] ..... B67D 5/06

[52] U.S. Cl. ..... 141/206; 141/46; 141/44; 141/59; 141/217; 141/226

[58] Field of Search ..... 141/44–46, 141/59, 206–229

[56] References Cited

U.S. PATENT DOCUMENTS

| | | | |
|---|---|---|---|
| 3,866,636 | 2/1975 | Lasater | 141/59 |
| 4,141,393 | 2/1979 | Mayer | 141/206 |
| 4,143,689 | 3/1979 | Conley et al. | 141/207 |
| 4,199,012 | 4/1980 | Lasater | 141/52 |
| 4,235,266 | 11/1980 | McMath | 141/285 |
| 4,343,337 | 8/1982 | Healy | 141/226 |
| 4,418,730 | 12/1983 | McMath | 141/207 |
| 4,429,725 | 2/1984 | Walker et al. | 141/59 |
| 4,566,504 | 1/1986 | Furrow et al. | 141/59 |
| 4,687,033 | 8/1987 | Furrow et al. | 141/59 |
| 4,749,009 | 6/1988 | Faeth | 141/45 |
| 4,827,987 | 5/1989 | Faeth | 141/59 |
| 4,842,027 | 6/1989 | Faeth | 141/45 |
| 4,951,720 | 8/1990 | Grantham | 141/44 |

FOREIGN PATENT DOCUMENTS

| | | | |
|---|---|---|---|
| 0155186 | 9/1985 | European Pat. Off. | 141/45 |

*Primary Examiner*—Ernest G. Cusick

*Attorney, Agent, or Firm*—Jacox & Meckstroth

[57] ABSTRACT

A fuel dispensing nozzle includes a nozzle body and a projecting spout and surrounding bellows which define a fuel supply passage and a vapor return passage connected to corresponding concentric passages within flexible coaxial hoses. The body supports a manually actuated control valve within the fuel passage, and a pressure responsive check valve is also located within the fuel passage adjacent the spout. The check valve includes a valve member normally biased against a tapered valve seat, and a first venturi suction passage extends from the valve seat to control a pressure responsive diaphragm mechanism for automatically closing the manually actuated valve when fuel blocks a suction vent line within the of the spout. A second venturi suction passage extends from the valve seat through the nozzle body and connects with a fuel evacuation passage within a flexible tube which extends downwardly into the vapor passage within the coaxial hoses. The vapor return passage within the nozzle body is normally closed by a spring biased valve member which opens in response to collapsing of the bellows, and excessive vapor pressure within the vapor passage also operates the diaphragm mechanism to close the manually actuated valve.

22 Claims, 2 Drawing Sheets

VAPOR RECOVERY FUEL DISPENSING NOZZLE

BACKGROUND OF THE INVENTION

In a vapor recovery fuel dispensing nozzle of the general type disclosed in U.S. Pat. Nos. 3,866,636, 4,143,689, 4,235,266 and 4,418,730, it is common to use a pressure responsive check valve in the fuel line or passage within the nozzle body adjacent the inner end of the fuel dispensing spout. The check valve opens when fuel is supplied through the manually actuated control valve within the nozzle body, and a venturi suction or bleed passage extends from the annular seat of the check valve to the outer end portion of the spout. The venturi passage also extends to a diaphragm actuated mechanism which automatically closes the manually actuated valve when the bleed passage is blocked by fuel at the outer end of the spout. This form of automatic fuel shutoff is also commonly used in conventional fuel dispensing nozzles without a vapor return passage for a vapor recovery system.

One of the problems encountered with a vapor recovery fuel dispensing system is the accumulation of liquid fuel within the vapor return passage of the flexible coaxial hoses as a result of condensation of fuel vapors within the passage and the splash back of fuel during use of the dispensing nozzle for refueling. If too much liquid fuel collects within the vapor return passage defined between the coaxial hoses, the vapor return passage becomes blocked, and the vapor recovery system no longer operates.

One system for removing accumulated liquid fuel within the vapor return passage defined between coaxial hoses, incorporates a venturi system as disclosed in U.S. Pat. No. 4,687,033. In this patent, the venturi system is located within a coupling which connects the coaxial hoses to the dispensing nozzle and includes a flexible rubber tube which extends downwardly into the annular vapor return passage defined between the coaxial hoses and terminates with an inlet located at the lowest point of the drape in the flexible hoses. The venturi system aspirates the liquid fuel within the vapor passage into the fuel supply passage which extends into the dispensing nozzle. The patent also mentions that the venturi system could also be located within the dispensing nozzle. Liquid fuel accumulated within the vapor return passage defined between the coaxial hoses has also been aspirated into the fuel supply passage by a venturi system located within the coaxial hoses at the lower most point of the drape in the hoses, and this venturi system is produced by Dayco Products, Inc.

The addition of a venturi aspirating system or device within the coaxial hoses or between the coaxial hoses and the dispensing nozzle as disclosed in above-mentioned U.S. Pat. No. 4,687,033, produces an additional flow restrictiion and pressure drop within the fuel supply passage extending to the dispensing nozzle. The flow rate reduction as a result of the additional restriction is on the order of 20% to 40%. Furthermore, the further upstream the venturi or aspirating device is located within the coaxial hoses, the higher the differential pressure that is required across the venturi or aspirating device to produce the desired suction. In order to obtain a higher pressure differential, the venturi must be more restrictive, which results in decreasing the flow rate.

The above-mentioned aspirating devices will not function properly below a minimum fuel flow rate such as 4 to 6 gallons per minute. To prevent a back flow of fuel through the venturi device and into the vapor return passage when the fuel flow rate is low due to partially opening the manually actuated flow control valve, a check valve is required in the venturi device. This check valve presents an additional pressure drop for which the venturi device must produce an additional pressure differential to overcome, thus further reducing the efficiency of the venturi device.

SUMMARY OF THE INVENTION

The present invention is directed to an improved vapor recovery fuel dispensing nozzle which incorporates a simplified and efficient system for removing or aspirating liquid fuel accumulated within the vapor return line or passage defined between coaxial hoses. The dispensing nozzle assembly of the invention also provides for a substantially higher fuel flow rate over other vapor recovery fuel dispensing systems with aspirating devices and, in addition, minimizes the cost and additional parts for incorporating an aspirating device in a vapor recovery fuel dispensing system.

In general, the above advantages and features are provided in accordance with the present invention by utilizing a single venturi device at the entrance of the fuel dispensing nozzle spout for obtaining dual functions. That is, the venturi device of the invention provides the conventional function of producing an air suction for actuating the diaphragm mechanism which automatically closes the manually actuated valve when the air suction bleed line within the fuel spout is blocked by fuel. In addition, the venturi device of the invention also functions to produce a suction to a passage which is connected by a tube extending through the nozzle body. The tube connects with a flexible tube which is laterally stiff and extends through the swivel connection and downwardly into the vapor return passage defined between the coaxial hoses.

Since the venturi device of the invention eliminates the need for a second venturi device or system within the fuel supply line, the fuel flow rate of the vapor recovery dispensing system is not decreased so that the desired maximum fuel flow rate of 9.5 to 10 gallons per minute may be obtained. Furthermore, since the venturi aspirating device of the invention is located at the inner end of the fuel dispensing spout where the maximum pressure drop is produced, the efficiency of aspiration is substantially increased by the invention so that a higher volume of condensed fuel is aspirated from the vapor return passage for a given flow of fuel through the supply passage. The venturi system of the invention also operates with a low flow rate of fuel and eliminates the need for a check valve to prevent a back flow of fuel into the vapor return passage during low fuel flow rates.

Other features and advantages of the invention will be apparent from the following description, the accompanying drawings and the appended claims.

DESCRIPTION OF THE PREFERRED EMBODIMENT

Figure 1:
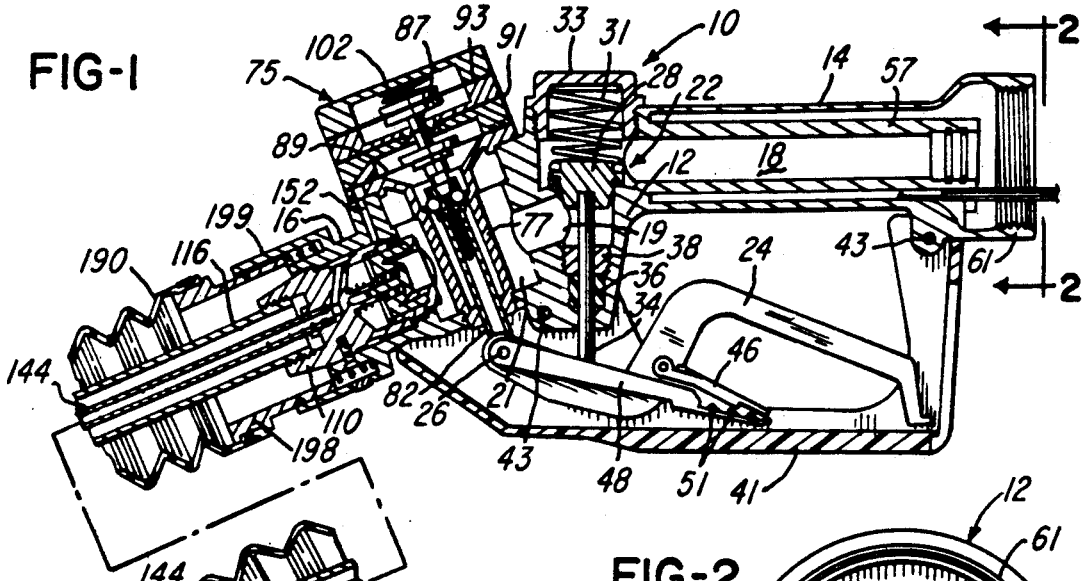
FIG. 1 is a longitudinal section through a vapor recovery fuel dispensing nozzle constructed in accordance with the invention and when the fuel and vapor flow control valves are normally closed.
Figure 5:
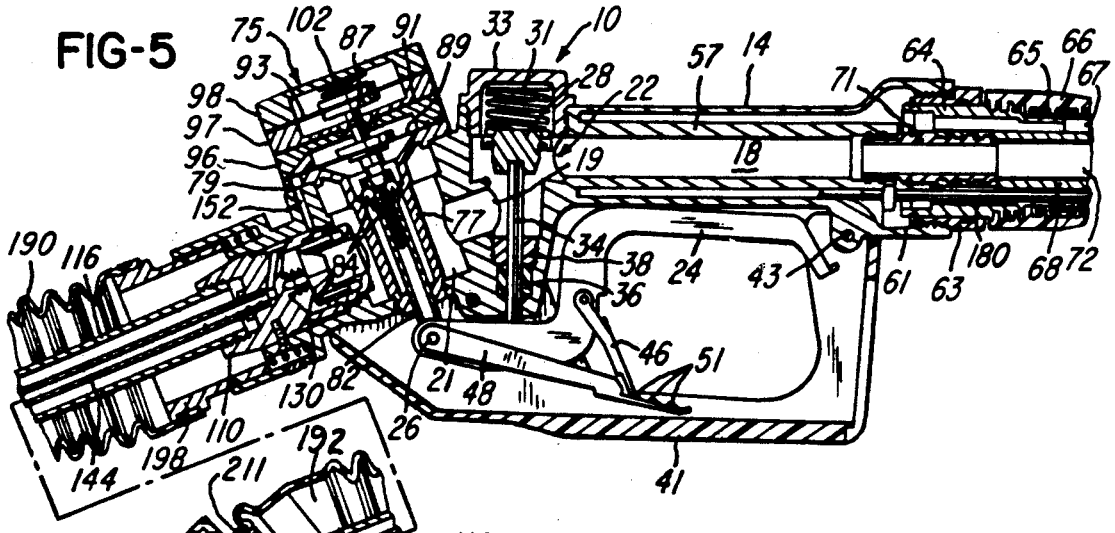
FIG. 5 is a longitudinal section similar to FIG. 1 and showing the fuel and vapor valves in their open positions when the nozzle is in use for dispensing fuel.
Figure 5:
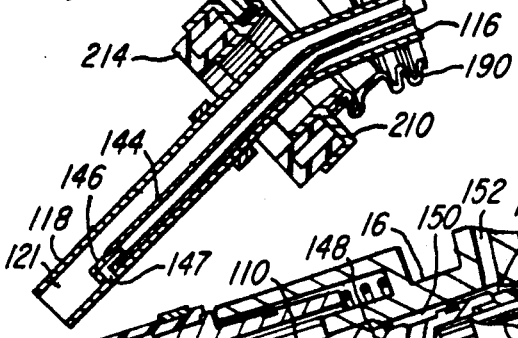

FIG. 1 shows a vapor recovery nozzle assembly 10 which includes a cast aluminum body 12 having a tubular handle portion 14 and an annular outlet portion 16. The body 12 defines internal fuel supply passages 18, 19 and 21, and a flow control valve 22 controls the flow of fuel from the passage 18 into the passages 19 and 21 in response to pivoting of a manually actuated control lever 24 about a pivot pin 26. The valve 22 includes a valve member 28 which is normally closed (FIG. 1) by a compression spring 31 confined within a cup-shaped plug 33 threaded into the body 12. A plunger 34 extends from the valve member 28 and engages the control lever 24, and suitable packing 36 is compressed around the plunger 34 by a fitting 38 to form a fluid-tight seal. The acutating lever 24 is enclosed within a plastic lever guard 41 which is secured to the body 12 by a pair of crossed pins 43. A set of levers 46 and 48 are pivotly connected to the actuating lever 24, and the lever 48 has a series of ribs 51 for selectively receiving the end of the lever 46 when the lever 24 is griped and moved upwardly (FIG. 1) to open the valve 22, as shown in FIG. 5.

Figure 4:
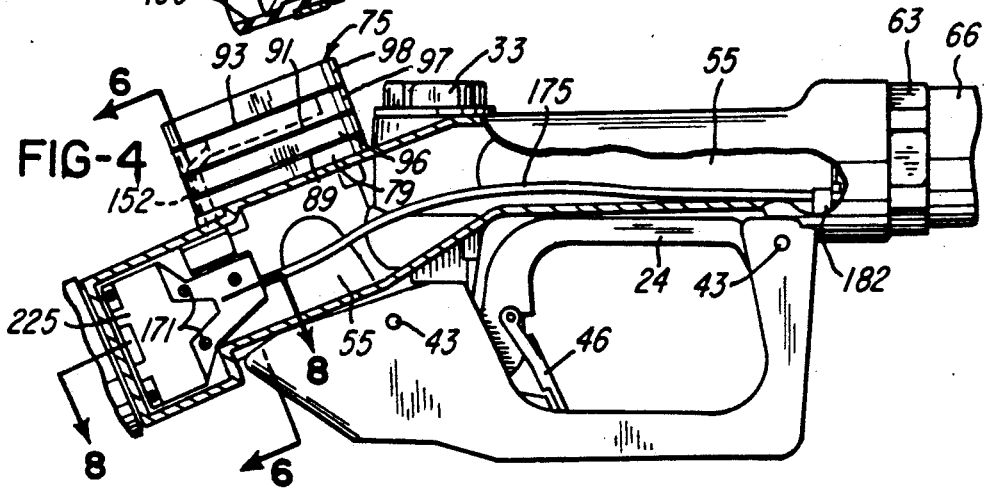
FIG. 4 is a fragmentary elevational view of the nozzle shown in FIG. 1 and with a side portion broken away to show the vapor return passage and fuel evacuating or aspirating line within the nozzle.

The body 12 also defines an internal vapor return passage 55 (FIGS. 2 and 4) which extends partially around a tubular portion 57 defining the fuel passage 18 within the handle portion 14. The vapor passage 55 extends from an enlarged internally threaded inlet portion 61 (FIG. 1) which receives an annular fitting 63 (FIG. 5). The fitting 63 rotatably supports a tubular sleeve 64 which is secured to one end of a flexible vapor return hose 65 by a molded plastic tube 66. As also shown in FIG. 5, the vapor return hose 65 defines an annular vapor return passage 67 which surrounds a flexible rubber-like fuel supply hose 68 which is concentric or coaxial with the outer hose 65. The fuel supply hose 68 is connected by a tubular coupling 71 which projects into the tubular portion 57 of the nozzle body 12, and the hose 68 defines a fuel supply passage 72 which is connected by the coupling 71 to the fuel supply passage 18 within the body 12. As apparent from FIG. 5, the sleeve 64 is free to rotate within the fitting 63, and the coupling 71 is free to rotate within the tubular portion 57, and suitable O-rings form fluid-tight seals so that the nozzle assembly 10 is free to swivel or rotate relative to the coaxial hoses 65 and 68.

An automatic shutoff mechanism 75 (FIG. 1 and 5) is supported by the body 12 and includes a tubular support member 77 which projects into the chamber or passage 21 and has a general square top flange portion 79 which seats on the body 12. The tubular portion 77 is sealed to the body 12 and supports a tubular actuating element 82 having a lower end portion which receives the pivot pin 26 supporting the forward end of the control valve actuating lever 24. The tubular actuating element 82 has an enlarged cylindrical upper end portion forming a cage for a set of balls 84 which normally engage a tapered or frusto-conical shoulder within the tubular member 77.

Figure 8:
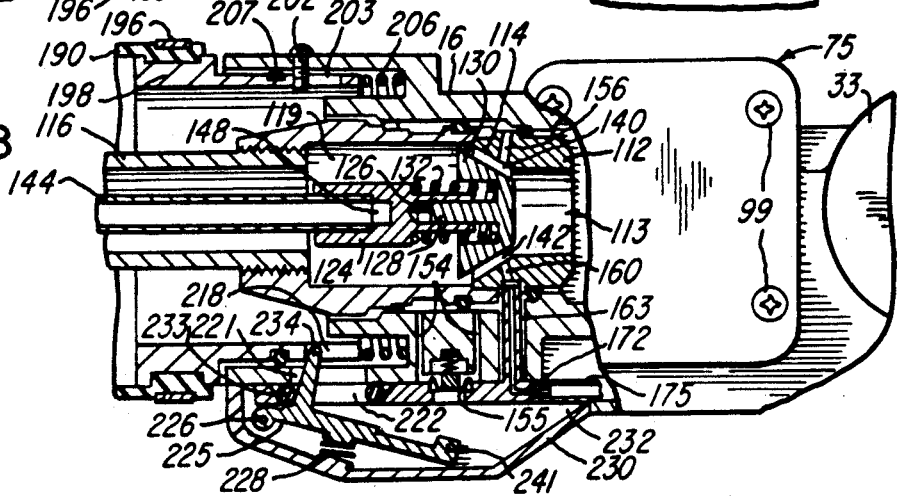
FIG. 8 is an enlarged fragmentary plan view of the nozzle assembly and with a portion shown in section as taken generally on the line 8—8 of FIG. 4.

The automatic shutoff or release mechanism 75 also includes a center actuating stem 87 which has a tapered portion for engaging the balls 84 and carries a set of three diaphragms 89, 91 and 93 sandwiched between the flange portion 79 of the member 77 and a set of cup-shaped disk elements 96, 97 and 98 secured to the body 12 by a set of screws 99 (FIG. 8). A light compression spring 102 normally urges the stem 87 inwardly or downwardly so that the balls 84 are cammed outwardly to engage the tapered seat within the member 77. When the element 87 is moved upwardly, the balls 84 are free to move inwardly out of engagement with the tapered seat so that the tubular actuating element 82 is free to move downwardly within the support member 77.

Figure 3:
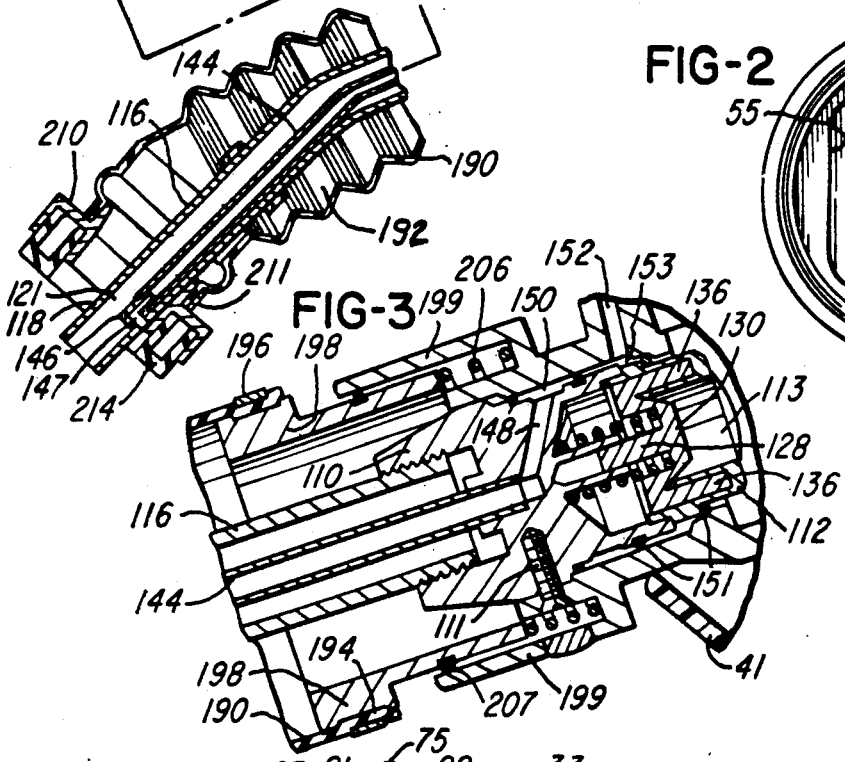
FIG. 3 is an enlarged fragmentary section of the fuel check valve and venturi device constructed in accordance with the invention and shown in FIG. 1.
Figure 7:
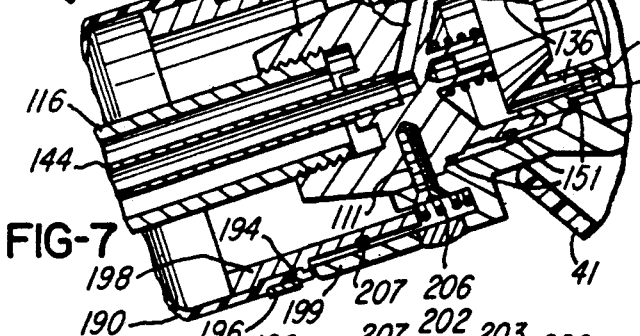
FIG. 7 is an enlarged fragmentary section similar to FIG. 3 and showing the check valve and venturi device of the invention in its open and operating position.

Referring to FIGS. 3, 7 and 8, the annular outlet portion 16 of the nozzle body 12 receives a support fitting or member 110 which is retained by a screw 111 and receives an annular seat member 112 defining a passage 113 and having an undercut tapered valve seat 114. The member 110 supports the inner end portion of a tubular fuel supply spout 116 having a downwardly turned end portion 118, as shown in FIGS. 1 and 5. The member 110 also defines a fuel supply passage 119 (FIG. 8) which connects the passage 113 to a fuel supply passage 121 defined by the spout 118. The passage 119 is divided by an internal rib portion 124 (FIG. 8) having a tubular portion 126 which receives a cylindrical stem portion 128 of a tapered check valve member 130. A compression spring 132 normally urges the valve member 130 against the tapered valve seat 114 to form a normally closed check valve.

The valve member 130 includes a pair of diametrically opposite cylindrical posts or pins 136 (FIG. 7) which projects axially into corresponding bores 138 formed within the valve seat member 112. The pins 136 and corresponding bores 138 interrupt the valve seat 114 and form two opposing semi-circular tapered flow passages 140 and 142 (FIG. 8) when the valve member 130 is moved to its open postion (FIGS. 7 and 8) in response to the pressure of fuel within the passage 113.

The center rib portion 124 of the support member 110 also supports an overfill shutoff air bleed tube 144 which extends longitudinally within the spout 116 and has an outer end portion connected by an elbow 146 (FIG. 5) to a radial port 147 within the outer end portion 118 of the spout 116. The inner end portion of the shutoff air bleed tube 144 is connected by a passage or port 148 (FIG. 7) to an annular chamber 150 defined between the body portion 16 and the outer surface of the support member 110 and between two of three O-ring seals 151. A suction port 152 (FIGS. 6 and 7) connects an adjacent annular chamber 153 to the shutoff mechanism 75 between the diaphragm 89 and the rolling bellows diaphragm 91, as shown in FIGS. 1 and 5. As shown in FIG. 8, the chambers 150 and 153 are connected by a pair of radial ports 154 which extend through the body portion 16 and through a rolling diaphragm valve element 155.

Figure 6:
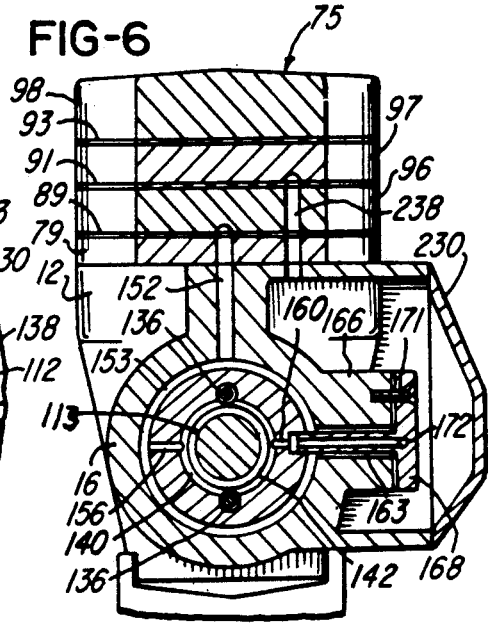
FIG. 6 is an enlarged fragmentary section taken generally on the line 6—6 of FIG. 4.

Referring to FIGS. 6–8, when the tapered valve element or member 130 is shifted to its open position, the arcuate flow passages 140 and 142 are separated by the pins or posts 136. A first venturi suction port 156 (FIG. 6) extends from the arcuate passage 140 to the annular chamber 153. As fuel flows through the passage 140, a suction is created within the port 156 and in the annular chamber 153. Air is sucked into the annular chambers 150 and 153 through the ports 148 and 154 and the overfill shutoff air bleed tube 144. However, when the air bleed port 147 within the outer end portion of the spout 118 is blocked by fuel, an increased suction is created within the chambers 150 and 153 and above the diaphragm 89 of the shutoff mechanism 75 through the port 152. As the stem member 87 moves upwardly due to the suction above the diaphragm 89, the balls 84 shift inwardly and release the tube 82 for downward movement so that the pivot support 26 for the handle 24 is released, and the fuel flow control valve 22 returns to its normally closed position in response to the force exerted by the spring 31.

Referring to FIG. 6, a second venturi suction passage or port 160 connects the fuel passage 142 to a suction port defined by a small tube 163 which extends from the seat member 112 radially outwardly through the annular chamber 153 and through a boss portion 166 of the nozzle body 12. A vapor valve plate 168 (FIG. 6) is secured to the boss portion 166 by a set of screws 171 (FIGS. 4 and 6) and defines a suction or evacuation port 172 (FIG. 8) forming an extension of the port within the tube 163. A deformable or flexible plastic evacuation tube 175 (FIGS. 4 and 8) extends rearwardly from the cover plate 168 through the vapor passage 55 within the nozzle body 12 and connects the port 172 to a suction or evacuation passage 178 (FIG. 2) defined within a flexible evacuation tube 180.

Figure 2:
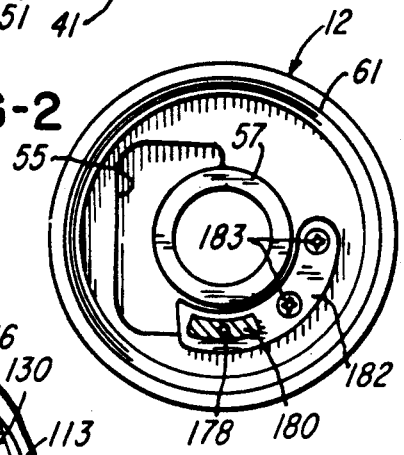
FIG. 2 is a an enlarged end view of the nozzle as taken generally on the line 2—2 of FIG. 1.

As shown in FIGS. 1 and 2, the inner end portion of the tube 180 extends into a recess within the tubular portion 57 and is secured to the nozzle body 12 by an arcuate retainer or holder 182 which is swagged to the tube and is secured to the body by a pair of screws 183. As also shown in FIG. 2, the flexible evacuation tube 180 is preferably molded of a flexible plastics material and has a width substantially greater than its thickness so that the tube is provided with substantial lateral stiffness. As shown in FIG. 5, the tube 180 extends from the nozzle assembly 10 downwardly into the draping coaxial hoses 65 and 68 and has an inlet end portion within the lowermost portion of the annular vapor return passage 67 defined between the coaxial hoses 65 and 68. The lateral stiffness of the evacuation tube 180 assures that the tube usually remains in the lower portion of the annular vapor return passage 67 when the nozzle assembly 10 rotates or swivels relative to the coaxial hoses during use of the nozzle assembly for dispensing fuel.

Referring to FIGS. and 5, a flexible and collapsible vapor recovery bellows 190 surrounds the fuel dispensing spout 118 and defines an annular vapor return passage 192 around the spout. The bellows 190 has an inner end portion 194 (FIG. 3) which is secured by a band 196 to the outer end portion of a tubular fitting 198 slidably supported by a cylindrical sleeve portion 199 of the nozzle body 12. As shown in FIG. 8, a stop pin or stud 202 is supported by the sleeve portion 199 and projects radially inwardly into an axially extending slot 203 within the fitting 198 to limit axial movement of the fitting within the sleeve portion 199. A compression coil spring 206 normally urges the fitting 198 outwardly to the extended position shown in FIG. 1, and a resilient O-ring 207 forms a fluid-tight seal between the fitting 198 and the sleeve 199. An annular cup element 210 (FIG. 1) is secured by a band 211 to the outer end portion of the bellows 190 and retains a resilient annular cup-shaped seal or gasket 214.

When the nozzle assembly 10 is used for dispensing fuel, and the spout 118 is extended into the inlet tube (not shown) extending from a fuel receiving tank, the gasket 214 engages the outer end of the fill tube, and the bellows 190 is compressed from its normal position (FIG. 1) to a collapsed position (FIG. 5). The force required to collapse the bellows 190 is sufficient to move the fitting 198 inwardly within the sleeve 199 to compress the spring 206, as shown in FIGS. 7 and 8. A notch or recess 218 (FIG. 8) is formed within the inner end portion of the fitting 198 and aligns with a hole or port 221 within the sleeve portion 199 when the fitting 198 is depressed inwardly. Another aligned hole or port 222 is formed within the plate 168, and the port 222 is normally closed by a vapor valve member 225 pivotly supported by a pivot pin 226 secured to ears projecting from the plate 168.

A compression spring 228 (FIG. 8) extends between the vapor valve member 225 and a cup-shaped cover member 230 (FIG. 6) which encloses the valve member 225 and defines a vapor return passage 232 for connecting the vapor return passage 192 within the bellows 190 to the vapor return passage 55 within the nozzle body 12 when the valve member 225 is open. The valve member 225 seats against a resilient O-ring 233 retained by the plate 168 and has a stud portion 234 (FIG. 8) which projects inwardly into the recess 218 within the fitting 198 so that the valve member 225 is pivoted to an open position (FIG. 8) when the fitting 198 is depressed inwardly into the sleeve portion 199.

As shown in FIG. 6, a vapor pressure port 238 connects the vapor return passage 232 to the chamber directly under the diaphragm 93 of the shutoff mechanism 75. In the event the vapor pressure within the chambers or passages 232 and 55 exceeds a predetermined upper limit, for example, ten inches of water, the actuating stem 87 is moved upwardly to release the balls 84 and permit the tube 82 to move downwardly for releasing the handle 24 and shutting off the flow control valve 22. As also shown in FIG. 8, when the valve member 225 pivots inwardly to close the vapor return port 222, the valve member 225 has a tip 241 which projects through a hole within the plate 168 and depresses the rolling diaphragm valve element 155 to close the passages 154 connecting the annular chambers 150 and 153. Thus any venturi suction within the passage 156 and chamber 153 when the vapor valve member 225 is closed immediately actuates the mechanism 75 to release the handle 24 and close the valve 22.

From the drawings and the above description, it is apparent that a vapor recovery fuel dispensing nozzle constructed in accordance with the present invention provides all of the desirable features and advantages mentioned above in the "Summary of the Invention". For example, by having two separated and independent venturi or suction ports 156 and 160 extending from the check valve seat 114, only one venturi system is required to actuate the automatic shutoff mechanism 75 and to aspirate liquid fuel accumulated within the vapor return passage 66 within the coaxial hoses. As a result, a higher flow rate is obtained through the coaxial hoses and the dispensing nozzle assembly 10. In addition, the substantial pressure drop to atmosphere across the check valve member 130 produces a higher suction and thus more efficient aspiration of liquid fuel from the vapor return passage. As a result, aspiration of condensed fuel within the vapor return passage 67 is obtained even with a relatively low fuel flow rate around the valve member 130. It is also apparent that the use of the valve member 130 and the separate venturi passages 140 and 142 for aspirating fuel from the vapor return passage as well as actuating the automatic shutoff mechanism 75, eliminates the need for a separate upstream aspirating system and the associated flow restriction, such as disclosed in above mentioned U.S. Pat. No. 4,687,033.

While the nozzle assembly herein described constitutes a preferred embodiment of the invention, it is to be understood that the invention is not limited to this precise assembly, and that changes may be made therein without departing from the scope and spirit of the invention as defined in the appended claims.

The invention having thus been described, the following is claimed:

1. A dispensing nozzle assembly adapted for use with a vapor recovery fuel dispensing system including flexible hoses defining a liquid fuel supply passage and a return vapor passage, said nozzle assembly comprising a nozzle body, an elongated fuel supply spout extending from said body, means defining a primary fuel supply passage and a return vapor passage extending from said spout through said body and for forming extensions of the corresponding passages within the hoses, a manually actuated fuel control valve within said fuel supply passage within said body, means for automatically closing said fuel control valve in response to the presence of fuel adjacent said spout, pressure responsive check valve means within said fuel supply passage downstream of said control valve and adjacent said spout, means for normally biasing said check valve means towards a closed position, said check valve means defining a first venturi suction passage connected to actuate said means for automatically closing said fuel control valve, means defining a second venturi suction passage extending from said check valve means, means for separating said first and second venturi passages of said check valve means, and means defining a fuel evacuation passage extending from said second venturi passage through said nozzle body and into the return vapor passage within the hoses for efficiently aspirating fuel condensed from vapor and accumulated within the return vapor passage within the hoses into the fuel flowing within said spout and for minimizing the fuel flow restrictions within the hoses and said nozzle assembly.

2. A nozzle assembly as defined in claim 1 wherein said check valve means includes a seat member having a tapered surface, and said first and second venturi passages extend from tapered surface.

3. A nozzle assembly as defined in claim 1 wherein said check valve means include a movable valve member and a seat member, and said separating means cooperate with said valve member and said seat member to form arcuate fuel flow passages for said first and second venturi passages.

4. A nozzle assembly as defined in claim 1 wherein said means for automatically closing said fuel control valve include flexible diaphragm means; means for releasing said control valve in response to movement of said diaphragm means, and means for moving said diaphragm means in response to a predetermined maximum vapor pressure within said vapor return passage within said body.

5. A nozzle assembly as defined in claim 1 wherein said means defining said fuel evacuation passage include a flexible evacuation tube adapted to extend into the vapor return passage within the hoses, and means providing said tube with lateral stiffness to maintain said tube usually within a lower portion of the vapor return passage within the hoses.

6. A nozzle assembly as defined in claim 1 wherein said means defining said vapor return passage include a collapsible tubular bellows surrounding said spout and having an inner end portion and an outer end portion, a tubular fitting connected to said inner end portion, said body including means supporting said fitting for axial movement, a normally closed vapor flow control valve within said vapor return passage within said body, and means for opening said vapor valve in response to axial movement of said fitting with collapsing of said bellows.

7. A nozzle assembly as defined in claim 1 wherein said check valve means include a valve member having an outer surface with a generally frusto-conical configuration, a seat member having an inner surface with a generally frusto-conical configuration and extending around said outer surface, said separating means include a set of circumferentially spaced posts extending axially from one of said surfaces, and the other said surface defines corresponding holes receiving said posts for axial sliding movement.

8. A nozzle assembly as defined in claim 1 wherein said body includes an outlet portion defining a bore, said check valve means include a support fitting disposed within said bore, a valve member and a seat member supported by said fitting, and said spout includes an inner end portion supported by said fitting.

9. A nozzle assembly as defined in claim 1 wherein said means defining said fuel evacuation passage within said body comprise an evacuation tube extending within said return vapor passage within said body.

10. A nozzle assembly as defined in claim 1 wherein said check valve means include a support member, means defining a set of separate suction chambers adjacent said support member, means defining a suction port connecting said suction chambers, a valve element disposed within said suction port, a movable vapor valve member within said vapor passage within said body, and means for closing said valve element and said suction port in response to closing said vapor valve member.

11. A nozzle assembly as defined in claim 1 wherein said means defining said fuel evacuation passage include a flexible evacuation tube adapted to extend into the vapor return passage within the hoses, and said tube having a width substantially greater than its thickness to provide said tube with lateral stiffness.

12. A dispensing nozzle assembly adapted for use with a vapor recovery fuel dispensing system including flexible hoses defining a liquid fuel supply passage and a return vapor passage, said nozzle assembly comprising a nozzle body, an elongated fuel supply spout extending from said body, means defining a primary fuel supply passage and a return vapor passage extending from said spout through said body and for forming extensions of the corresponding passages within the hoses, a manually actuated fuel control valve within said fuel supply passage within said body, means for automatically closing said fuel control valve in response to the presence of fuel adjacent said spout, pressure responsive check valve means within said fuel supply passage downstream of said control valve and including a valve member supported for movement relative to a stationary valve seat, means for biasing said valve member towards a normally closed position adjacent said valve seat, means defining a first venturi suction passage extending from said valve seat and connected to actuate said means for automatically closing said fuel control valve, means defining a second venturi suction passage extending from said valve seat, said valve member and said valve seat including means for separating said first and second venturi passages, and means defining a fuel evacuation passage connected to said second venturi passage and adapted to extend into the return vapor passage within the hoses for efficiently aspirating fuel condensed from vapor and accumulated within the return vapor passage within the hoses into the fuel flowing within said spout and for minimizing fuel flow restrictions within the hoses and said nozzle assembly.

13. A nozzle assembly as defined in claim 12 wherein said valve seat is tapered, said valve member has a tapered surface adjacent said seat, and said separating means extend between said tapered surface and said tapered seat to form separate arcuate fuel flow passages for said first and second venturi passages.

14. A nozzle assembly as defined in claim 12 wherein said means defining said fuel evacuation passage include a flexible evacuation tube adapted to extend into the vapor return passage within the hoses, and means providing said tube with lateral stiffness to maintain said tube usually within a lower portion of the vapor return passage within the hoses.

15. A nozzle assembly as defined in claim 12 wherein said means defining said vapor return passage include a collapsible tubular bellows surrounding said spout and having an inner end portion and an outer end portion, a tubular fitting connected to said inner end portion, said body including means supporting said fitting for axial movement, a normally closed vapor flow control valve within said vapor return passage within said body, and means for opening said vapor valve in response to axial movement of said fitting with collapsing of said bellows.

16. A nozzle assembly as defined in claim 12 wherein said valve member has an outer surface with a generally frusto-conical configuration, said seat has a generally frusto-conical configuration and extends around said outer surface, said separating means include a set of circumferentially spaced posts extending axially from said outer surface, and said seat defines corresponding holes receiving said posts for axial sliding movement.

17. A nozzle assembly as defined in claim 12 wherein said means defining said fuel evacuation passage comprise a deformable evacuation tube extending within said return vapor passage within said body.

18. A dispensing nozzle assembly adapted for use with a vapor recovery fuel dispensing system including flexible hoses defining a liquid fuel supply passage and a return vapor passage, said nozzle assembly comprising a nozzle body, an elongated fuel supply spout extending from said body, means defining a primary fuel supply passage and a return vapor passage extending from said spout through said body and for forming extensions of the corresponding passages within the hoses, a manually actuated fuel control valve within said fuel supply passage within said body, means for automatically closing said fuel control valve in response to the presence of fuel adjacent said spout, a single flow restriction means downstream of said control valve and defining first and second venturi suction passages, said first venturi suction passage connected to actuate said means for automatically closing said fuel control valve, and means defining a fuel evacuation passage extending from said second venturi passage through said nozzle body and, adapted to extend into the return vapor passage within the hoses for efficiently aspirating fuel condensed from vapor and accumulated within the return vapor passage within the hoses into the fuel flowing within said spout and for minimizing the fuel flow restrictions within the hoses and said nozzle assembly.

19. A nozzle assembly as defined in claim 18 wherein said single flow restriction means comprise a check valve including a seat member having a tapered surface, and said first and second venturi passages extend from tapered surface.

20. A nozzle assembly as defined in claim 18 wherein said single flow restriction means comprise a check valve including a movable valve member and a seat member, and said separating means cooperate with said valve member and said seat member to form arcuate fuel flow passages for said first and second venturi passages.

21. A nozzle assembly as defined in claim 18 wherein said means defining said vapor return passage include a collapsible tubular bellows surrounding said spout and having an inner end portion and an outer end portion, a tubular fitting connected to said inner end portion, said body including means supporting said fitting for axial movement, a normally closed vapor flow control valve within said vapor return passage within said body, and means for opening said vapor valve in response to axial movement of said fitting with collapsing of said bellows.

22. A dispensing nozzle assembly adapted for use with a vapor recovery fuel dispensing system including flexible hoses defining a liquid fuel supply passage and a return vapor passage, said nozzle assembly comprising a nozzle body, an elongated fuel supply spout extending from said body, means associated with said body and defining a primary fuel supply passage and a return vapor passage extending from said spout for forming extensions of the corresponding passages within the hoses, a fuel control valve within said fuel supply passage within said body, means for automatically closing said fuel control valve in response to the presence of fuel adjacent said spout, means defining a fuel flow restriction passage within said body, means defining a first venturi suction passage extending from said restriction passage and connected to actuate said means for automatically closing said fuel control valve, means defining a second venturi suction passage extending from said restriction passage and separated from said first venturi passage, and means associated with said body and defining a fuel evacuation passage extending from said second venturi passage into the return vapor passage within the hoses for efficiently aspirating fuel condensed from vapor and accumulated within the return vapor passage within the hoses into the fuel flowing within said spout and for minimizing the fuel flow restrictions within the hoses and said nozzle assembly.

* * * * *